US008491356B2

(12) United States Patent
Walker

(10) Patent No.: US 8,491,356 B2
(45) Date of Patent: Jul. 23, 2013

(54) ADJUSTABLE KNIFE SHARPENER

(75) Inventor: Shane R. Walker, Eau Claire, WI (US)

(73) Assignee: National Presto Industries, Inc., Eau Claire, WI (US)

( * ) Notice: Subject to any disclaimer, the term of this patent is extended or adjusted under 35 U.S.C. 154(b) by 633 days.

(21) Appl. No.: 12/705,890

(22) Filed: Feb. 15, 2010

(65) Prior Publication Data

US 2011/0201257 A1 Aug. 18, 2011

(51) Int. Cl.
*B24B 3/36* (2006.01)
*B24B 23/02* (2006.01)

(52) U.S. Cl.
USPC ..... 451/349; 451/358; 451/371

(58) Field of Classification Search
USPC ..... 451/349, 358, 371, 45
See application file for complete search history.

(56) References Cited

U.S. PATENT DOCUMENTS

| | | | | |
|---|---|---|---|---|
| 3,831,325 | A | 8/1974 | Joray et al. | |
| 3,956,856 | A | 5/1976 | Yonkers | |
| 3,993,116 | A | 11/1976 | Brewer | |
| 4,005,554 | A | 2/1977 | Campbell | |
| 4,085,547 | A | 4/1978 | Lawson et al. | |
| 4,807,399 | A | 2/1989 | Friel | |
| 4,915,709 | A | 4/1990 | Andrew et al. | |
| 5,245,791 | A | 9/1993 | Bigliano et al. | |
| 5,591,069 | A | 1/1997 | Wurthman | |
| 5,611,726 | A | 3/1997 | Friel et al. | |
| 5,620,359 | A | 4/1997 | Harrison et al. | |
| D409,891 | S | 5/1999 | Friel et al. | |
| 6,012,971 | A | 1/2000 | Friel, Sr. et al. | |
| 6,071,181 | A * | 6/2000 | Wightman et al. | 451/192 |
| 6,113,476 | A | 9/2000 | Friel, Sr. et al. | |
| 6,125,740 | A | 10/2000 | Hedrington et al. | |
| 6,267,652 | B1 | 7/2001 | Friel, Sr. et al. | |
| 6,354,194 | B1 | 3/2002 | Hedrington et al. | |
| 6,709,320 | B2 * | 3/2004 | Li | 451/349 |
| 6,967,036 | B1 | 11/2005 | Hedrington et al. | |
| 6,969,299 | B1 | 11/2005 | Papetti | |
| 7,104,874 | B1 | 9/2006 | Gussack et al. | |
| 7,134,935 | B1 | 11/2006 | Papetti | |
| 7,189,142 | B2 * | 3/2007 | Da Batista | 451/8 |
| 7,235,004 | B2 * | 6/2007 | Friel et al. | 451/198 |
| 7,374,470 | B2 | 5/2008 | Fuchs | |
| 7,517,275 | B2 * | 4/2009 | Friel et al. | 451/198 |
| 2007/0026771 | A1 | 2/2007 | Harden et al. | |
| 2008/0176496 | A1 | 7/2008 | Tasi | |
| 2008/0261494 | A1 | 10/2008 | Friel et al. | |
| 2009/0075570 | A1 | 3/2009 | Levsen | |

FOREIGN PATENT DOCUMENTS

| | | |
|---|---|---|
| FR | 2827535 | 1/2003 |
| JP | 2160462 A | 6/1990 |

* cited by examiner

*Primary Examiner* — Dung Van Nguyen
(74) *Attorney, Agent, or Firm* — Patterson Thuente Pedersen, P.A.

(57) ABSTRACT

A motorized knife sharpener and related methods of sharpening knives, wherein the knife sharpener is capable of sharpening knives of varying types and styles. The motorized knife sharpener includes a housing, motorized grinding assembly and an adjustable blade guide assembly. The adjustable blade guide assembly includes a selector switch accessible to a user on a front portion of the housing. With the selector switch, the user is able to selectively adjust a presentation angle defined by a blade guide relative to a grinding wheel. The selector switch is operably coupled to the blade guide with a cam assembly that pivots the blade guide with respect to the grinding wheel so as to vary the blade presentation angle.

12 Claims, 12 Drawing Sheets

ADJUSTABLE KNIFE SHARPENER

FIELD OF THE INVENTION

The present invention relates to consumer knife sharpeners. More particularly, the present invention relates to an electrically powered knife sharpener including a selector switch for adjusting a blade presentation angle to a grinding wheel based upon the type of knife to be sharpened.

BACKGROUND OF THE INVENTION

Consumer knife sharpeners are well known in the industry. Typical knife sharpeners include a housing that includes a motorized grinding assembly as well as one or more guides for positioning a blade for sharpening. Representative knife sharpeners of the prior art are described and illustrated in U.S. Pat. Nos. 4,915,709; 5,611,726; and 5,620,359, as well as U.S. Patent Publication No. 2008/0176496A1, all of which are herein incorporated by reference.

Due to differences in knife design and usage, many sharpeners have been developed or optimized for very specific blade types. To achieve optimum sharpening results, each type of blade must be presented to the rotating side face of a grinding wheel at an angle that is suitable for the existing type of cutting edge found on the blade. The angle of presentation changes significantly depending upon the type of blade, for example a cleaver or hunting knife must be presented at a significantly greater included angle with respect to the plane of the rotating side face of a grinding wheel than a paring knife or a fillet knife. For instance, specific sharpening devices have been developed for thick blades or shears such as, for example, U.S. Pat. No. 5,245,791, which specifically addresses sharpening of scissors. In another example of a sharpener designed for a specific sharpening application, U.S. Patent Publication No. 2008/0261494A1 describes a sharpening device for hunting and Asian knives. U.S. Pat. No. 5,245,791 and U.S. Patent Publication No. 2008/0261494A1 are both incorporated by reference in their entirety.

While powered knife sharpeners are well known in the art, it would be advantageous to increase the versatility of these sharpeners such that a single knife sharpener can accommodate the unique sharpening requirements of a variety of blade types and styles.

SUMMARY OF THE INVENTION

A representative knife sharpener of the present invention comprises a housing, a motorized grinding assembly and an adjustable blade guide assembly. The adjustable blade guide assembly includes a selector switch accessible to a user on a front portion of the housing. With the selector switch, the user is able to selectively adjust a presentation angle defined by a blade guide relative to a grinding wheel. The selector switch is operably coupled to the blade guide with a cam assembly that pivots the blade guide relative to the grinding wheel so as to vary the presentation angle of the blade to the grinding wheel.

In one aspect, the present invention is directed to a knife sharpener including an adjustable blade guide assembly such that a knife sharpener can be utilized successfully with a variety of blade styles and thicknesses. With the adjustable blade guide assembly, a user is able to adjust a blade presentation angle defined by a blade guide and a corresponding grinding wheel. The adjustable blade guide assembly includes a selector switch accessible on a front portion of the knife sharpener, wherein the user simply moves the selector switch to a setting providing a suitable blade presentation angle for the type of knife to be sharpened.

In another aspect, the present invention is directed to a method for sharpening a knife using a motorized knife sharpener. The method includes identifying a type of knife to be sharpened. The method further includes adjusting a presentation angle defined between a blade guide and a grinding wheel such that the presentation angle is appropriate for the knife being sharpened. Adjusting the presentation angle can comprise the step of positioning a selector switch to a setting corresponding with the type of knife to be sharpened. Adjusting the presentation angle can further comprise interfacing with a cam assembly for operably interfacing with a blade guide assembly to pivot the blade guide assembly relative to the grinding wheel.

In another aspect, the present invention is directed to a motorized knife sharpener configured to sharpen a variety of knife types and styles. The motorized knife sharpener can comprise a housing enclosing means for sharpening a knife blade, means for positioning the knife blade relative to the means for sharpening and means for adjusting the means for positioning based on the type and style of the knife being sharpened. The means for sharpening can include a motorized grinding assembly including a motor and at least one grinding wheel. The means for positioning the knife blade can comprise at least one blade guide assembly and one slot assembly for slidably receiving and retaining the knife blade relative to the grinding wheel. The means for adjusting can comprise a selector switch operably coupled to a cam assembly to selectively pivot the blade guide assembly relative to the grinding wheel. The means for adjusting allows a user to select an appropriate presentation angle for the type of blade to be sharpened, wherein the presentation angle is defined by the grinding wheel and the blade guide assembly.

The above summary of the various representative embodiments of the invention is not intended to describe each illustrated embodiment or every implementation of the invention. Rather, the embodiments are chosen and described so that others skilled in the art may appreciate and understand the principles and practices of the invention. The figures in the detailed description that follows more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
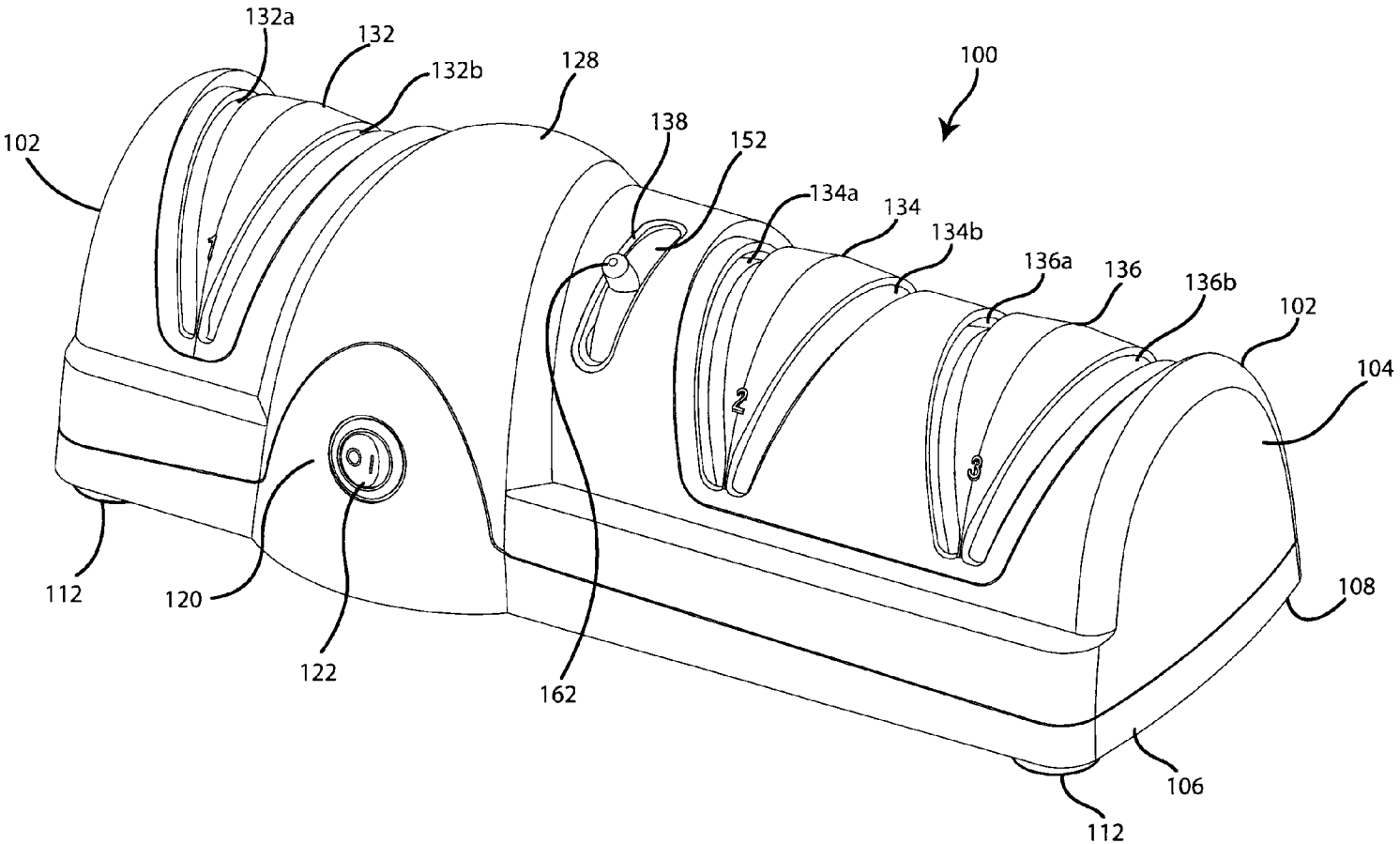
FIG. 1 is a front, perspective view an adjustable knife sharpener according to an embodiment of the present invention.
Figure 2:
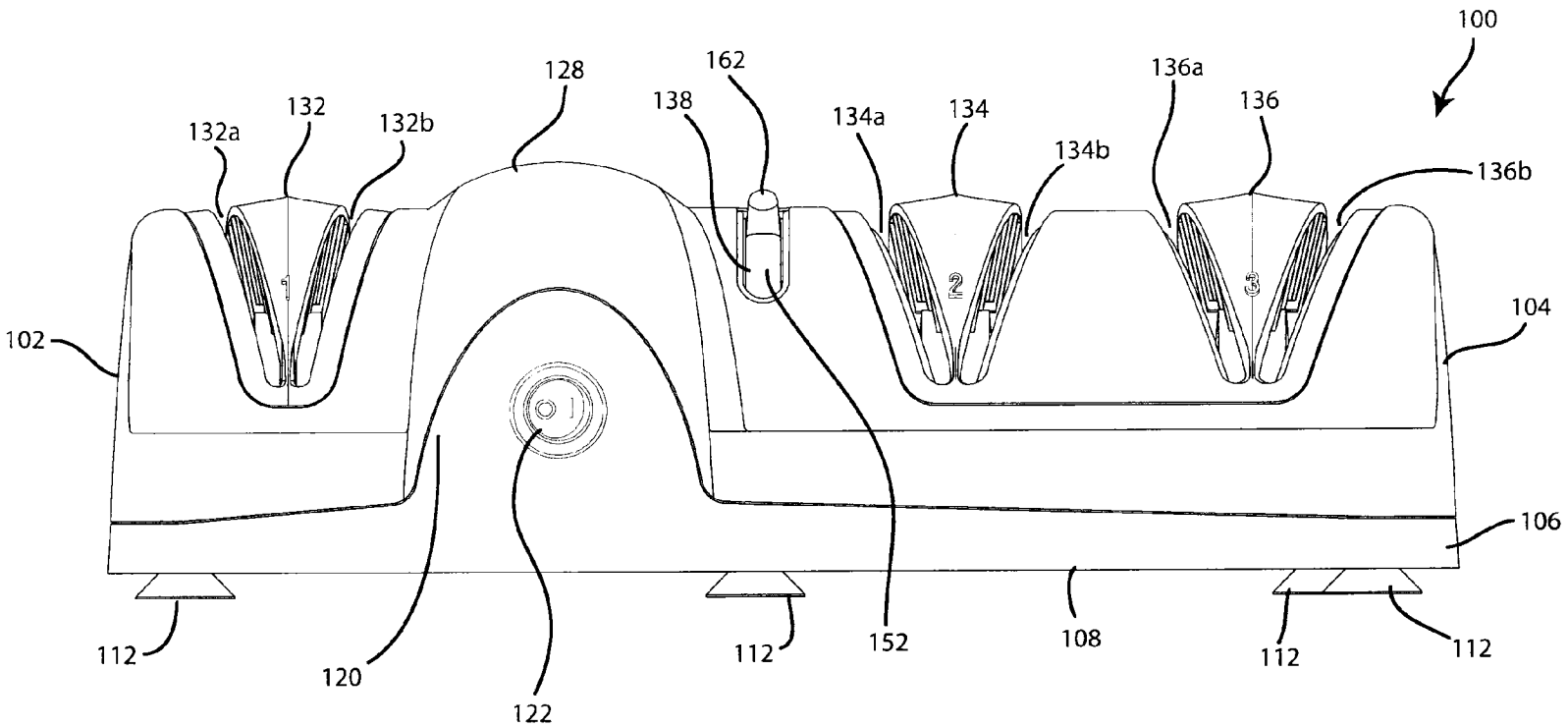
FIG. 2 is a front view of the adjustable knife sharpener of FIG. 1.
Figure 3:
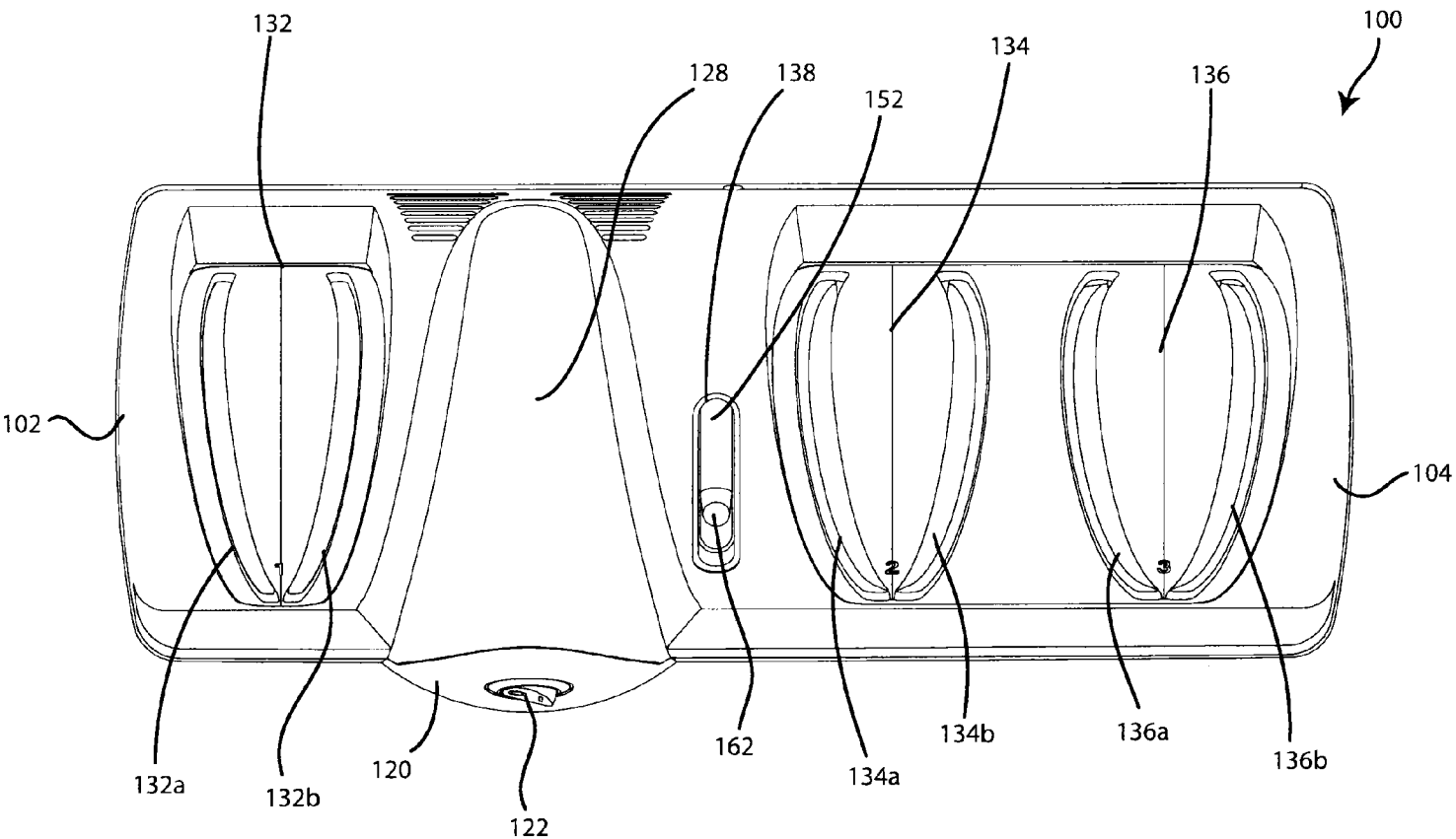
FIG. 3 is a top view of the adjustable knife sharpener of FIG. 1.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE DRAWINGS

In the following detailed description of the present invention, numerous specific details are set forth in order to provide a thorough understanding of the present invention. However, it will be obvious to one skilled in the art that the present invention may be practiced without these specific details. In other instances, well-known methods, procedures, and components have not been described in detail so as to not unnecessarily obscure aspects of the present invention.

Referring now to FIGS. 1, 2, 3 and 4, a representative embodiment of an adjustable knife sharpener 100 is depicted. Adjustable knife sharpener 100 generally comprises a housing assembly 102, an adjustable blade guide assembly 150 and a grinding assembly 200 as shown in FIGS. 1, 2, 3, 4 and 5.

Referring now to FIGS. 1, 2, 3, 4 and 5, housing assembly 102 generally comprises an upper sharpening portion 104 and a lower base platform 106. Upper sharpening portion 104 and lower bade platform 106 generally comprise a molded polymeric material such as, for example, ABS (Acrylonitrile Butadiene Sytrene) or polypropylene and the like. Lower base platform 106 generally defines a bottom surface 108 and an upwardly facing mounting floor 110. Bottom surface 108 can include a plurality of feet 112 that function to dampen vibration and reduce slippage on a table or countertop surface during use. Mounting floor 110 can include a plurality of upwardly projecting guide structures 114, a motor mount bracket 116 and a grinding wheel mount bracket 118. Lower base platform 106 can further comprise a front portion 120 including a power switch 122. Lower base platform 106 further defines a platform perimeter 124 including a perimeter lip 126.

As illustrated in FIGS. 1, 2, 3 and 4, upper sharpening portion 104 generally defines an upper access surface 128 and a lower attachment perimeter 130. While not depicted, it will be understood that lower attachment perimeter 130 is dimensionally and geometrically a match for platform perimeter 124 and includes an internal lip so as to provide a lap joint connection to the perimeter lip 126. Upper sharpening portion 104 can further include a plurality of bosses configured to slidably receive the guide structures 114 during connection of the upper sharpening portion 104 and lower base platform 106. While not illustrated, it will be understood that traditional fasteners such as, for example, screw or snap-style fasteners can be employed when connecting the upper sharpening portion 104 and lower base platform 106.

Upper access surface 128 defines a plurality of sharpening stages including a first sharpening stage 132 (for coarse grinding), a second sharpening stage 134 (for medium grinding) and a third sharpening stage 136 (for honing of the blade). Each of the different sharpening stages includes a pair of corresponding blade slots, for example, blade slots 132*a*, 132*b* for the first sharpening stage 132, blade slots 134*a*, 134*b* for the second sharpening stage 134 and blade slots 136*a*, 136*b* for the third sharpening stage 136. Upper access surface 128 further comprises an elongated slot 138. Depending upon the condition of the blade to be sharpened, first sharpening stage 132 may not be used as part of the sharpening process. For instance, blades that are extremely dull or damaged may require an initial coarse grind while blades that remain in generally good condition may be proceed directly to the second sharpening stage 134.

Referring now to FIGS. 4, 5, 6, 7, 8, 9, 10 and 11, adjustable blade guide assembly 150 generally comprises a selector switch 152, a pair of blade guides 154, 156, a coupling member 158 and a cam member 160. Selector switch 152 generally includes a projecting biasing member 162, a pair of mounting posts 164 and an engagement recess 166. Coupling member 158 includes an engagement post 168 and a non-circular aperture 170. Cam member 160 includes a cam shaft 172 including a first end 174 having a generally circular cross-section and a second end 176 having a non-circular cross section. The cross-section of second end 176 substantially resembles the non-circular aperture 170 with the exception that second end 176 is slightly reduced in size so as to be slidably insertable through the non-circular aperture 170. Cam shaft 172 can include a plurality of projecting shaft rings 177 extending outwardly from the cam shaft 172. Cam shaft 172 includes a pair of cam assemblies 178 and 180. Each cam assembly comprises a pair of cam pockets, for instance, cam assembly 178 includes cam pockets 178*a*, 178*b* and cam assembly 180 includes cam pockets 180*a*, 180*b*. An angled cam slot 181 is located within each of the individual cam pockets. Each of blade guides 154, 156 includes a pair of guide members, for example, blade guide 154 includes guide members 154*a*, 154*b* and blade guide 156 include guide members 156*a*, 156*b*. Each of the individual guide members includes a pair of mounting ends 182, a support post 183 and a guide surface 184. A plurality of cam brackets 186 including a semi-circular recess 188 for engaging the cam shaft 172 and an enlarged capture portion 190 for accommodating the projecting shaft ring 177.

Figure 4:
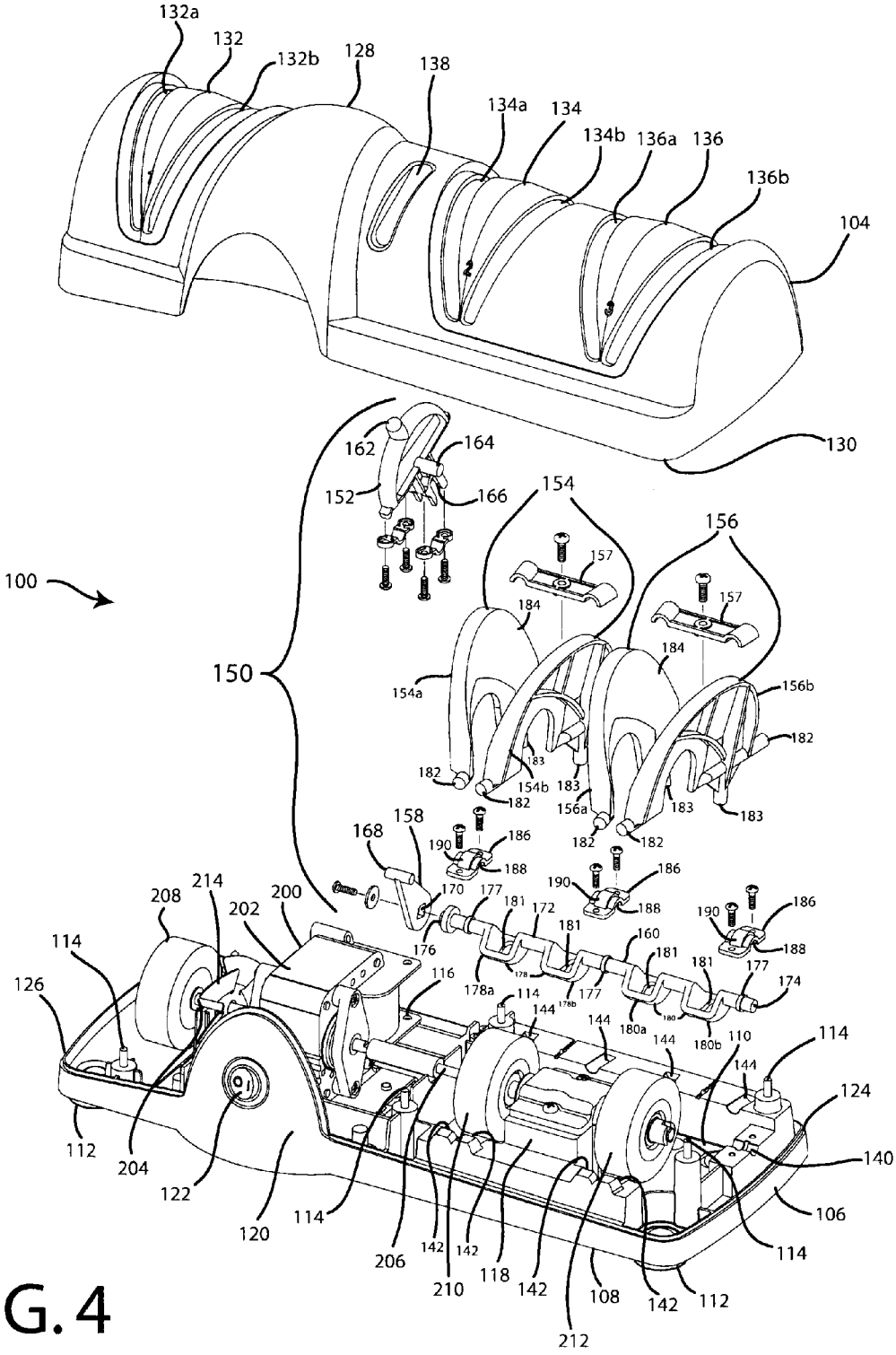
FIG. 4 is an exploded, front, perspective view of the adjustable knife sharpener of FIG. 1.
Figure 5:
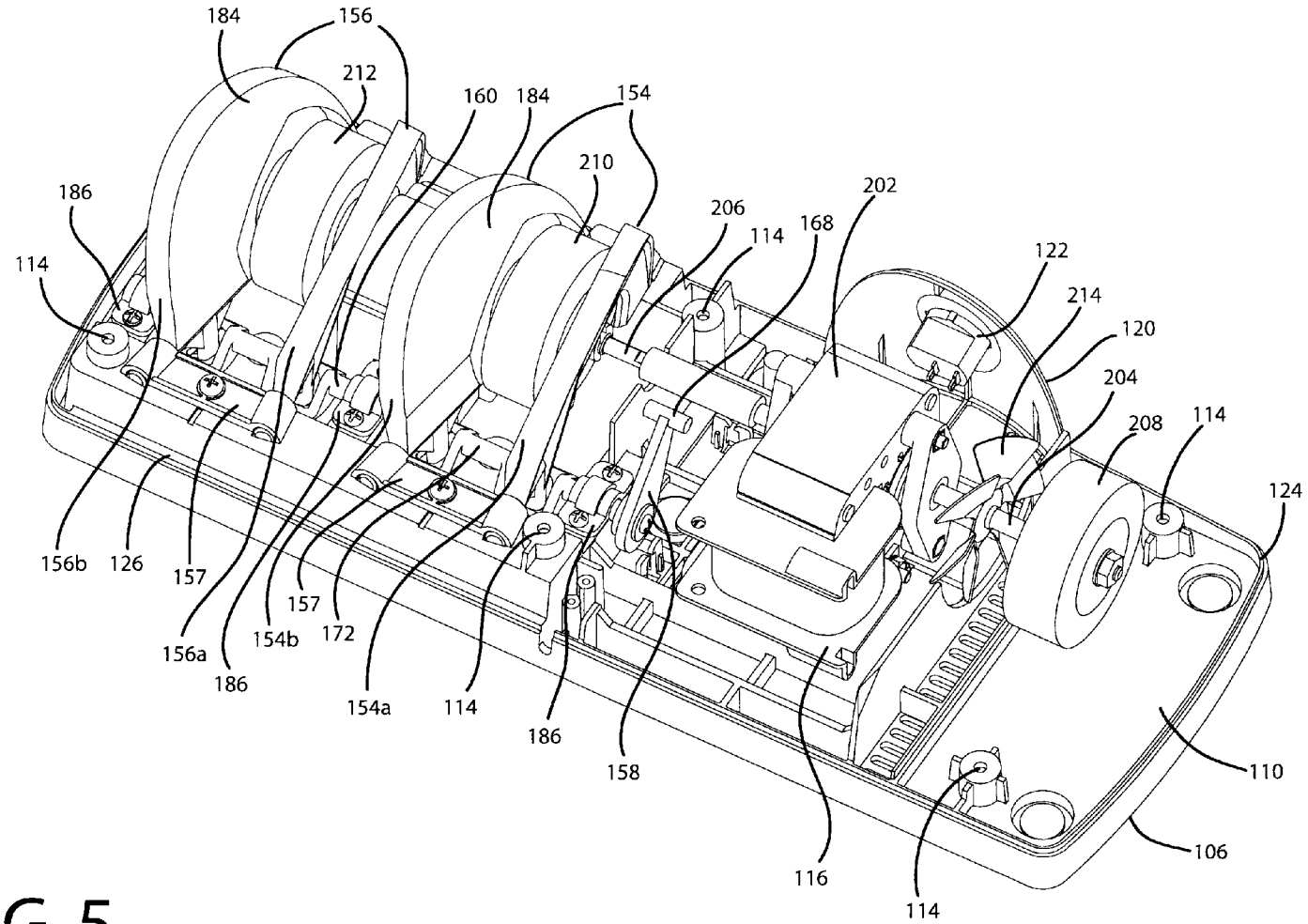
FIG. 5 is a rear, perspective view of a partially assembled adjustable knife sharpener.
Figure 6:
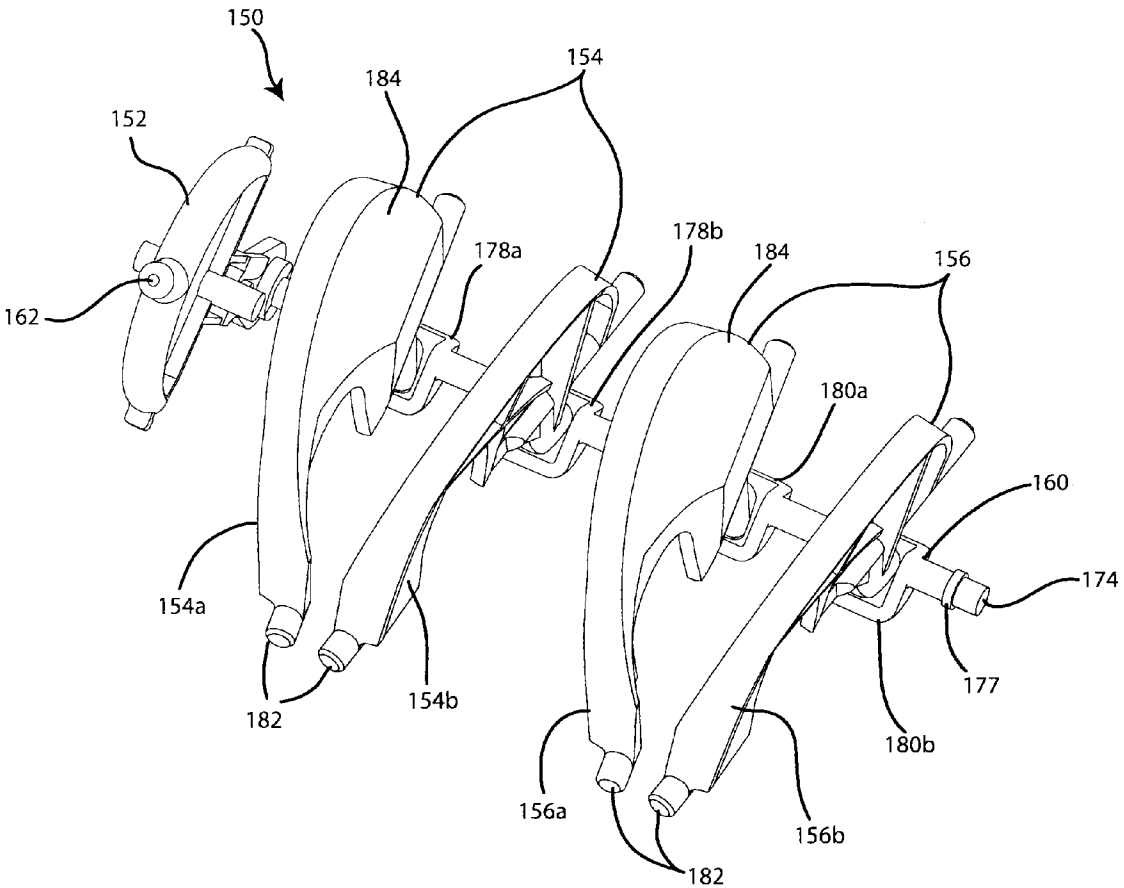
FIG. 6 is a front, perspective view of an adjustable blade guide assembly according to an embodiment of the present invention.
Figure 7:
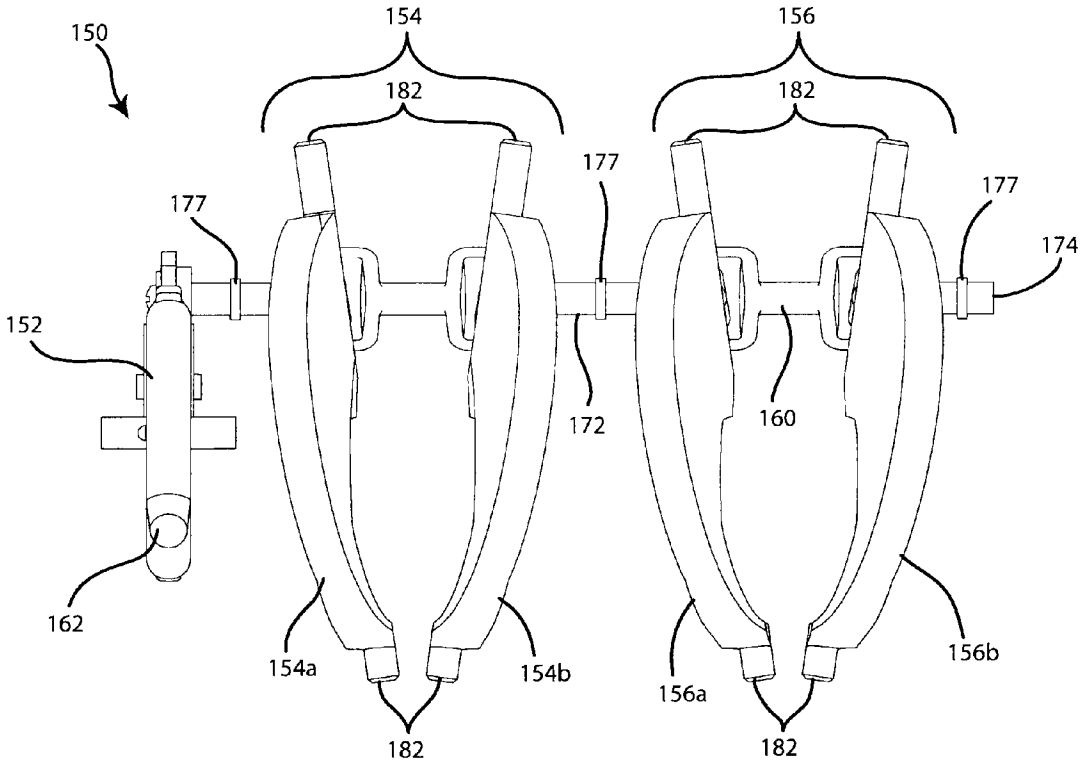
FIG. 7 is a top view of the adjustable blade guide assembly of FIG. 6.
Figure 8:
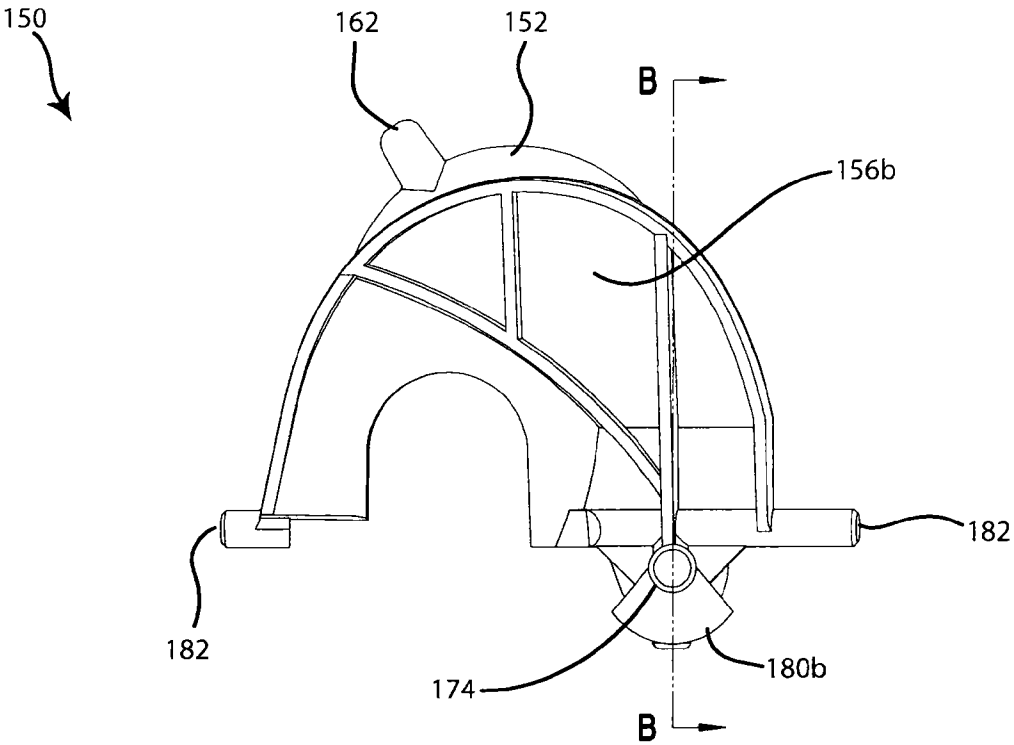
FIG. 8 is a right, side view of the adjustable blade guide assembly of FIG. 6.
Figure 9:
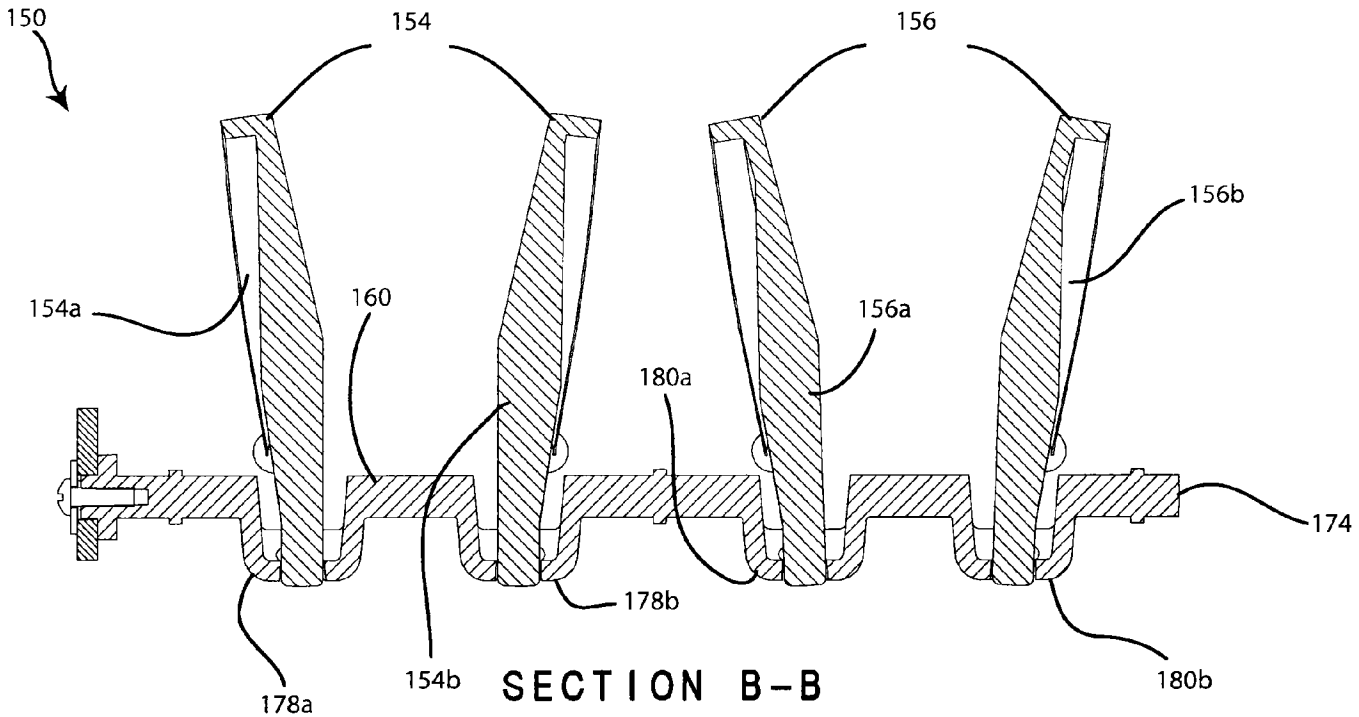
FIG. 9 is section view of the adjustable blade guide assembly of FIG. 6 taken at line B-B of FIG. 8.
Figure 10:
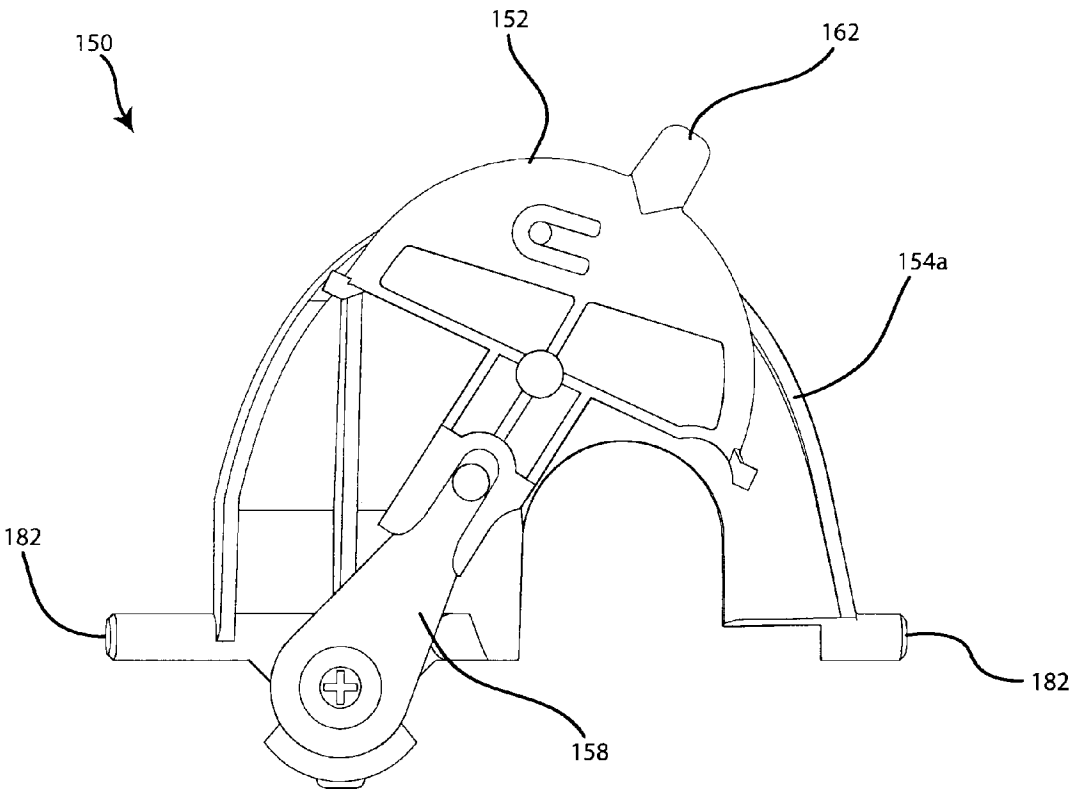
FIG. 10 is a left, side view of the adjustable blade guide assembly of FIG. 6.
Figure 11:
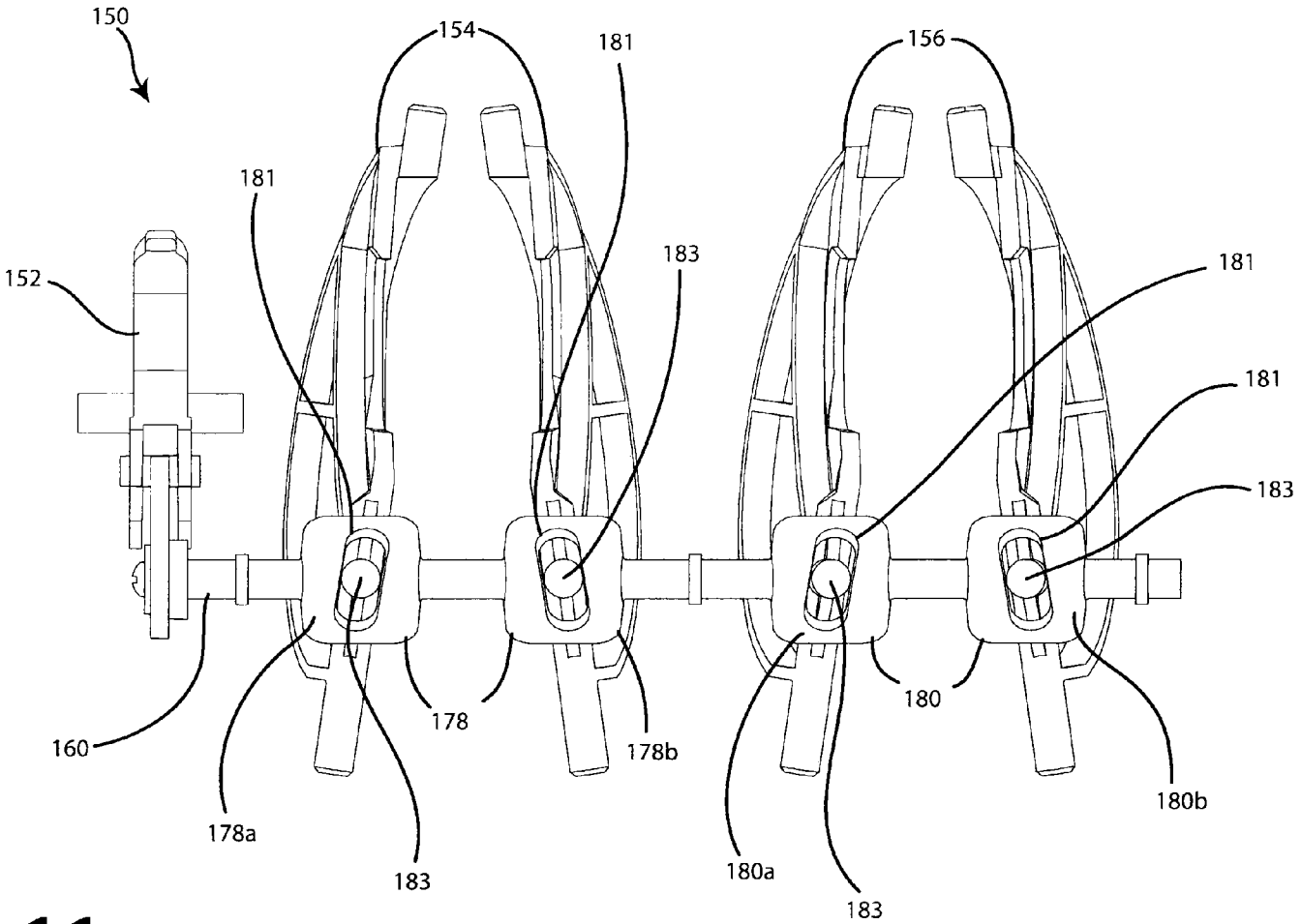
FIG. 11 is a bottom view of the adjustable blade guide assembly of FIG. 6.

As illustrated in FIGS. 4 and 5, grinding assembly 200 generally comprises a motor assembly 202, a first shaft assembly 204, a second shaft assembly 206, a first grinding wheel 208, a second grinding wheel 210 and a third grinding wheel 212. First grinding wheel 208, second grinding wheel 210 and third grinding wheel 212 can comprise conventional designs and materials including, for example, aluminum oxide, silicon carbide, ceramic and ceramic composites and combinations thereof. First grinding wheel 208 is rotatably coupled to the first shaft assembly 204. Second grinding wheel 210 and third grinding wheel 212 are rotatably coupled to the second shaft assembly 206. A fan blade 214 can be rotatably attached to either shaft assembly so as to convectively cool the motor assembly 202 during use. While not part of the present invention, it will be understood that first shaft assembly 204 and second shaft assembly 206 can comprise a variety of additional components including, for example, bearing and coupling members, so as to provide safe and reliable operation of the grinding assembly 200. The construction of the various grinding wheels is generally based on their particular function. For example, first grinding wheel 208 generally functions as an initial stage and in some instances, will not be utilized unless a blade to be sharpened is very dull. First grinding wheel 208 can be constructed to have a 100 wheel grit. Second grinding wheel 210 can be constructed to have a 180 wheel grit. Third grinding wheel 212 can be constructed to have a 220 wheel grit.

To assemble the adjustable knife sharpener 100, the grinding assembly 200 is attached to the mounting floor 110 using the motor mount bracket 116 and grinding wheel mount bracket 118. With the grinding assembly 200 in place, the cam member 160 is positioned such that first end 174 is placed into a recess 140 on the lower base platform 106. The cam brackets 186 are then positioned over the cam member 160 such that as the cam brackets 186 are fastened to the mounting floor 110, the enlarged capture portions 190 capture the corresponding projecting shaft ring 177. With the cam member 160 attached to the mounting floor 110, the non-circular aperture 170 of coupling member 158 is placed over the second end 176, whereby a suitable fastening element such as, for example, the illustrated screw and washer fixedly retain engagement of the coupling member 158 and the cam member 160. Guide members 154*a*, 154*b*, 156*a*, 156*b* are positioned such that one of the mounting ends 182 are slidably inserted into receiving bores 142 on the lower base platform 106 while the opposed mounting end 182 resides on a corresponding receiving notch 144 on the lower base platform 106. Guide brackets 157 are positioned over the mounting end 182 and receiving notch 144 and are subsequently fastened to the mounting floor 110. As the mounting ends 182 are positioned relative to the mounting floor 110, support post 183 is slidably inserted into the corresponding angled cam slot 181. The selector switch 152 is oriented such that the engagement recess 166 is positioned over the engagement post 168 on the coupling member 158 and the upper sharpening portion 104 is attached to the lower base platform 106 with the selector switch 152 mounted within the elongated slot 138.

Before use, a user determines which type of blade is to be sharpened and based on that determination, the user selectively adjusts the adjustable blade guide assembly 150 by utilizing selector switch 152 with biasing member 162 to select the presentation angle of the blade for the second sharpening stage 134 and third sharpening stage 136. In use, a user first turns the power switch 122 to the on position so as to energize the motor assembly 202. The motor assembly 202 causes both the first shaft assembly 204 and second shaft assembly 206 to spin such that the first grinding wheel 208, second grinding wheel 210 and third grinding wheel 212 spin at a suitable grinding speed.

In the event that the blade requires coarse grinding, the user slidably inserts a rear potion of a blade to be sharpened within blade slot 132*a*, such that a right side facet of a blade edge is presented to the first grinding wheel 208. Once the right side facet has been sharpened, the process is repeated with the blade being inserted into blade slot 132*b* wherein the opposed side surface of the blade is sharpened by pulling the blade toward the individual such that the length of the blade is drawn through the blade slot 132*b* with the left side facet of a blade edge being presented to the first grinding wheel 208. The desired sharpening angle of the first grinding stage 132 is fixed and is defined by the interaction of blade slots 132*a*, 132*b* with first grinding wheel 208. As discussed previously, the first grinding stage 132 is generally used only with blades that are extremely dull or damaged and require a coarse grind before the true sharpening stages.

Following coarse grinding at first sharpening stage 132 or proceeding directly to second sharpening stage 134, a similar process is repeated. The blade is positioned with blade slot 134*a*, a side surface of the blade is positioned against the guide surface 184 of guide member 154*a* such that a right side facet of a blade edge is presented to the second grinding wheel 210 at the selected sharpening angle as dictated by selector switch 152. Once the right side facet has been sharpened, the process is repeated with the blade being inserted into blade slot 134*b* wherein the opposed side surface of the blade is positioned against the guide surface 184 of guide member 154*b*. In this manner, the left side facet of the blade edge is presented to the second grinding wheel 210 at the desired sharpening angle.

Following second sharpening stage 134, the sharpening process is completed by following a similar process at third sharpening stage 136. The blade is positioned with blade slot 136*a*, a side surface of the blade is positioned against the guide surface 184 of guide member 156*a* such that a right side facet of a blade edge is presented to the third grinding wheel 212 at the selected sharpening angle as dictated by selector switch 152. Once the right side facet has been sharpened, the process is repeated with the blade being inserted into blade slot 136*b* wherein the opposed side surface of the blade is positioned against the guide surface 184 of guide member 156*b*. In this manner, the left side facet of the blade edge is presented to the third grinding wheel 212 at the desired sharpening angle.

With the inclusion of the adjustable blade guide assembly 150, the number of knife types and styles that can be sharpened using adjustable knife sharpener 100 is increased. Adjustable blade guide assembly 150 allows the user to selectively adjust the presentation angle of the blade facet to the second and third grinding wheels depending upon the knife type. For instance, a relatively "thick" knife such as, for example, a hunting knife having a blade thickness of 0.180-0.200 inches should be sharpened at a blunter angle than a "thin" knife, such as, for example, a fish filleting knife having a thickness of 0.030-0.040 inches.

Figure 12C:
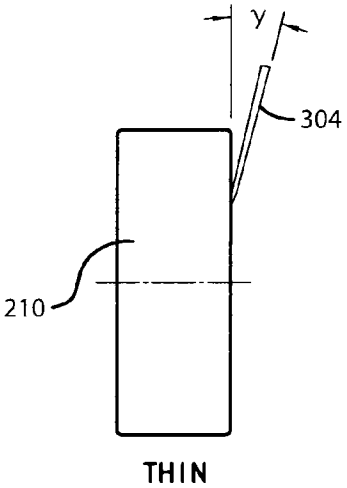
FIG. 12*c* is a front view of a blade presentation angle defined by a grinding wheel and a blade guide for a thin blade.
Figure 12B:
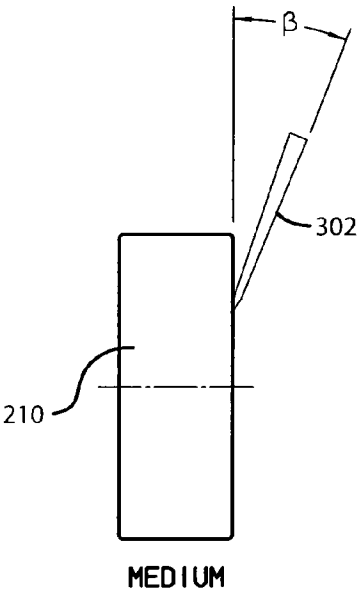
FIG. 12*b* is a front view of a blade presentation angle defined by a grinding wheel and a blade guide for a medium thickness blade.
Figure 12A:
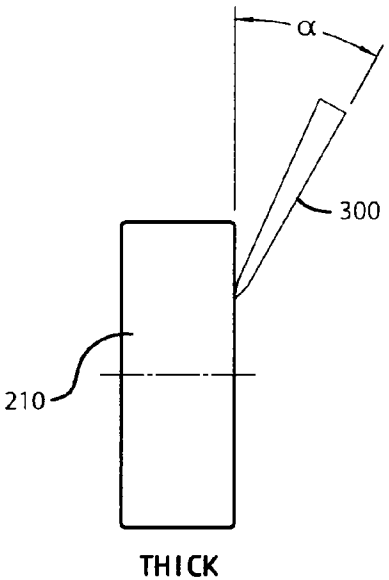
FIG. 12*a* is a front view of a blade presentation angle defined by a grinding wheel and a blade guide for a thick blade.

When sharpening a thick knife 300 such as a hunting knife or cleaver, the user manipulates the biasing member 162 on the selector switch 152 to an uppermost position relative to the elongated slot 138. Through the interaction of the selector switch 152 with the coupling member 158, the cam member 160 is caused to rotate such that cam assemblies 178, 180 are oriented to a rearward most position relative to front portion 120. As the cam assemblies 178, 180 are directed rearward, support post 183 on each of guide members 154*a*, 154*b* and 156*a*, 156*b* slides within the angled cam slots 181. As the support posts 183 move within the angled cam slots 181, the corresponding guide members 154*a*, 154*b* and 156*a*, 156*b* pivot upon mounting ends 182 such that a blade presentation angle as defined by the guide members 154*a*, 154*b* with the second grinding wheel 210 and guide members 156*a*, 156*b* with the third grinding wheel 212 respectively, is adjusted to define an angle $\alpha$ as shown in FIG. 12*a*. As shown in FIGS. 12*a*, 12*b* and 12*c*, the various blade presentation angles are depicted relative to the second grinding wheel 210 though it will be understood that the same concept applies to third grinding wheel 212.

When sharpening a knife having a blade of medium thickness 302 such as, for example, kitchen or chef's knives, the user manipulates the biasing member 162 on the selector switch 152 to a midpoint position relative to the elongated slot 138. Through the interaction of the selector switch 152 with the coupling member 158, the cam member 160 is caused to rotate such that cam assemblies 178, 180 are oriented to a midpoint position. As the cam assemblies 178, 180 move, the support posts 183 slide to a midpoint location of the angled cam slots 181. As the support posts 183 move to this midpoint position within the angled cam slots 181, guide members 154*a*, 154*b* and 156*a*, 156*b* pivot correspondingly such that a blade presentation angle as defined by the guide members 154*a*, 154*b* and 156*a*, 156*b* and the second grinding wheel 210 and the third grinding wheel 212 respectively, is adjusted to define an angle β as shown in FIG. 12*b*.

When sharpening a thin knife 304, the user manipulates the biasing member 162 on the selector switch 152 to a lowermost position relative to the elongated slot 138. Again, the interaction of the selector switch 152 with the coupling member 158 causes the cam member 160 to rotate such that cam assemblies 178, 180 are oriented to forward most position. As the cam assemblies 178, 180 move forward, the support posts 183 slide within the angled cam slots 181, guide members 154*a*, 154*b* and 156*a*, 156*b* pivot upon mounting ends 182 such that the blade presentation angle as defined by the guide members 154*a*, 154*b* and 156*a*, 156*b* and the second grinding wheel 210 and the third grinding wheel 212 respectively, is adjusted to define an angle γ as shown in FIG. 12*c*.

In a representative embodiment of the invention, the adjustable blade guide assembly 150 can be used to provide the adjustable knife sharpener 100 with blade presentation angles as follows:

| | Stage | | |
|---|---|---|---|
| Blade Type | Stage 1 Blade Presentation Angle (Fixed) | Stage 2 Blade Presentation Angle | Stage 3 Blade Presentation Angle |
| Thin | 15-19° | 15-19° | 17-21° |
| Medium-Thickness | 15-19° | 17-21° | 19-23° |
| Thick | 15-19° | 19-23° | 21-25° |

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents.

The invention claimed is:

1. A knife sharpener, comprising:

a housing enclosing a grinding assembly and an adjustable blade guide assembly, wherein the grinding assembly includes at least two grinding wheels and the adjustable blade guide assembly includes a selector switch and at least two pairs of guide members operably connected to the selector switch, wherein movement of the selector switch to a desired setting causes each pair of guide members to pivot relative to their corresponding grinding wheel such that a blade presentation angle is selectively defined between the pairs of guide members and their corresponding grinding wheel.

2. The knife sharpener of claim 1, wherein the grinding assembly includes a third grinding wheel and wherein a third pair of guide members is fixed to define a constant blade angle between the third grinding wheel and the third pair of guide members.

3. The knife sharpener of claim 1, wherein the selector switch defines at least two angle settings, the angle settings corresponding to a blade thickness of a blade to be sharpened.

4. A knife sharpener, comprising:

a housing enclosing a grinding assembly and an adjustable blade guide assembly, the adjustable blade guide assembly including a selector switch and at least one pair of guide members, wherein the selector switch and the at least one pair of guide members is operably connected with a cam assembly, the cam assembly including at least one pair of cam pockets, each camp pocket having an angled cam slot and wherein each guide member includes a support post, each guide member being operably connected to the corresponding cam pocket by insertion of the support post into the angled cam slot, and wherein movement of the selector switch to a desired setting causes both guide members to pivot relative to the grinding assembly such that a blade presentation angle is selectively defined between both guide members and the grinding assembly.

5. The knife sharpener of claim 4, wherein manipulation of the selector switch causes the cam assembly to rotate such that each support post slides within the corresponding angled cam slot, wherein each guide member is pivoted relative to the grinding assembly to vary the blade presentation angle.

6. The knife sharpener of claim 5, wherein the blade presentation angle is adjustable from 15° to 21° for a thin blade.

7. The knife sharpener of claim 5, wherein the blade presentation angle is adjustable from 17° to 23° for a medium-thickness blade.

8. The knife sharpener of claim 5, wherein the blade presentation angle is adjustable from 19° to 25° for a thick blade.

9. A knife sharpener, comprising:

a housing enclosing a grinding assembly;

a selector switch operably mounted in the housing such that the selector switch is accessible on a front portion of the housing; and a means for adjusting a blade presentation angle of a blade to be sharpened relative to the grinding assembly, wherein the means for adjusting is operably connected to the selector switch, and wherein the means for adjusting includes a cam assembly and at least one guide member, wherein movement of the selector switch to a desired setting causes the cam assembly to rotate such, that the guide member is pivoted relative to the grinding assembly to adjust the blade presentation angle.

10. The knife sharpener of claim 9, wherein the cam assembly includes at least one cam pocket including an angled cam slot and wherein the guide member includes a support post, the guide member being operably connected to the cam pocket by insertion of the support post into the angled cam slot.

11. The knife sharpener of claim 10, wherein rotation of the cam assembly causes the support post to slide within the angled cam slot to pivot the guide member relative to the grinding assembly to vary the blade presentation angle.

12. The knife sharpener of claim 9, wherein the selector switch defines at least two blade settings, the blade settings corresponding to a blade thickness of the blade to be sharpened.

* * * * *